United States Patent [19]

Allard

[11] Patent Number: 5,018,319

[45] Date of Patent: May 28, 1991

[54] PNEUMATIC TUBE SELECTOR MECHANISM

[75] Inventor: James J. Allard, Vacaville, Calif.

[73] Assignee: Pauli & Griffin, Vacaville, Calif.

[21] Appl. No.: 322,575

[22] Filed: Mar. 13, 1989

[51] Int. Cl.[5] ..... B24C 9/00

[52] U.S. Cl. ..... 51/424; 51/273; 98/42.06; 98/115.1

[58] Field of Search ..... 51/424, 425, 426, 273; 98/42.06, 42.02, 115.1, 115.3

[56] References Cited

U.S. PATENT DOCUMENTS

| | | | |
|---|---|---|---|
| Re. 22,047 | 3/1942 | Grant, Jr. | 98/115.1 |
| 2,033,466 | 3/1936 | Grant, Jr. | 98/86 |
| 2,912,918 | 11/1959 | Mead | 98/115.1 |
| 3,863,392 | 2/1975 | Haker | 51/426 |

FOREIGN PATENT DOCUMENTS

| | | | |
|---|---|---|---|
| 0166077 | 11/1955 | Australia | 51/426 |
| 0060759 | 3/1943 | Denmark | 51/273 |
| 0061709 | 12/1943 | Denmark | 51/273 |

*Primary Examiner*—Robert A. Rose
*Attorney, Agent, or Firm*—Flehr, Hohbach, Test, Albritton & Herbert

[57] ABSTRACT

A pneumatic tube selector mechanism is provided for use in conjunction with an abrasive sandblast media recovery system. The tube selector selectively couples a vacuum source to any particular one of a plurality of discrete media collection locations which may take the form of tube and hopper sections. The tube selector mechanism includes an intake manifold having a multiplicity of intake ducts. A selector plate is rotationally coupled to the inlet manifold. The selector plate has an opening that is coupled to a vacuum duct which in turn is coupled to the vacuum source. A drive motor rotates the selector plate relative to the intake manifold, while a positioning mechanism controls rotation of the selector plate to selectively couple the selector plate opening to any particular one of the intake ducts. A vent valve is provided for venting the vacuum duct while the selector plate is rotated.

16 Claims, 3 Drawing Sheets

PNEUMATIC TUBE SELECTOR MECHANISM

The present invention relates generally to reclamation systems for abrasive media blast rooms. More particularly, the present invention relates to a mechanism for selectively coupling a vacuum source to particular recovery tubes to recycle the abrasive media.

BACKGROUND OF THE INVENTION

Before an automobile or other machinery is repainted, it is generally necessary to remove the old paint. The most efficient way to remove old paint is to sandblast the machinery. Originally, sand was used as the abrasive media. However, sand has a drawback in that it is not generally reusable. Therefore, several artificial abrasive materials have been developed that are reusable. In order to recycle the blasting media, it must be collected and separated from paint chips and other dust and debris. In high volume operations, a dedicated blast room is often provided to serve as the area in which blasting will take place. Rather than requiring the operators to sweep up after every blasting, several blast rooms have either partially or fully grated floors which cover a collection system for collecting the blasting media, as well as any dust and paint particles that are generated during blasting. One conventional collection system uses a multiplicity of tube and hopper sections that are arranged as collection bins that collect the blasting media, as it falls through the grating screen. In full floor systems, the entire floor is covered by the tube and hopper collection system, while in partial systems, a portion of the floor is grated and the operators need only sweep debris on the ungrated portions into the portion of the floor that covers the blasting media collection system. With either arrangement, the tube and hopper sections must be coupled to a vacuum source that sucks the recovered media into a separating chamber.

Tube and hopper collection systems typically include a plurality of spaced apart parallel riser tubes. The riser tubes are independent and each has a multiplicity of funnel shaped hoppers that feed into the tube. The open end of the hoppers face upward and collect the blasting media. The collected materials are channeled into the associated riser tube, which is in communication with the vacuum source.

One problem that frequently occurs with large systems is that it is not cost effective to use a vacuum source that is large enough to simultaneously apply suction to the entire collection system. Therefore, it is desirable to independently apply the vacuum source to particular tube and hopper sections that are sized appropriately for the vacuum source. The entire collection system is cleaned by sequentially applying the vacuum to the various sections.

One prior art attempt to selectively apply a vacuum source to particular sections of the floor recovery system uses a large header at the end of the riser tubes. The vacuum source is coupled to the header. Each riser tube has an actuatable flap that covers its end adjacent the header. The flaps are normally kept in the down position where they cover their associated riser tubes. A controller selectively opens the flaps to sequentially provide suction to the various riser tube sections. Although such a system does allow the use of a substantially smaller vacuum source than would otherwise be necessary, the header arrangement requires a large amount of space, is relatively expensive, and since it has a large number of moving parts in direct contact with the abrasive material, it is relatively prone to failure. Therefore, there is a need for an improved selector mechanism for abrasive material reclamation systems.

SUMMARY OF THE INVENTION

Accordingly, it is a primary objective of the present invention to provide a blasting material recovery system that allows selective recovery from a multiplicity of discrete areas.

Another objective is to provide a rotary tube selector for selectively coupling a vacuum source to one of a plurality of tubes that carry abrasive materials.

Another objective is to provide a selector mechanism that does not require starting and stopping the vacuum source when the vacuum is applied to discrete sections.

To achieve the forgoing and other objects and in accordance with the purpose of the present invention, a pneumatic tube selector mechanism is provided for use in conjunction with a vacuum source to recover abrasive blasting media from a plurality of discrete locations. The tube selector mechanism includes an intake manifold having a multiplicity of intake ducts. A selector plate is rotationally coupled to the inlet manifold. The selector plate has an opening that is coupled to a vacuum duct which in turn is coupled to the vacuum source. A drive means rotates the selector plate relative to the intake manifold. Positioning means is provided to precisely control the rotation of the selector plate to selectively couple the selector plate opening to any particular one of the intake ducts. A vent valve is provided for venting the vacuum duct while the selector plate is rotated.

In a preferred embodiment, a set of rollers is mounted to the selector plate and the intake manifold includes an annular track about which the roller may travel. The positioning means includes a rim adjacent the track that has plurality of alignment recesses and the roller includes cam followers that follow the rim as the selector plate is rotated. The cam followers cooperate with the alignment recesses to precisely position the selector plate relative the to intake manifold to insure that the vacuum duct is properly positioned over the selected intake duct.

In another preferred embodiment, the vent means includes a selectively actuatable flap that when open allows the influx of a substantial amount of air into the vacuum duct at a position between the vacuum source and the selector plate to prevent good communication therebetween.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF THE DRAWINGS

Figure 1:
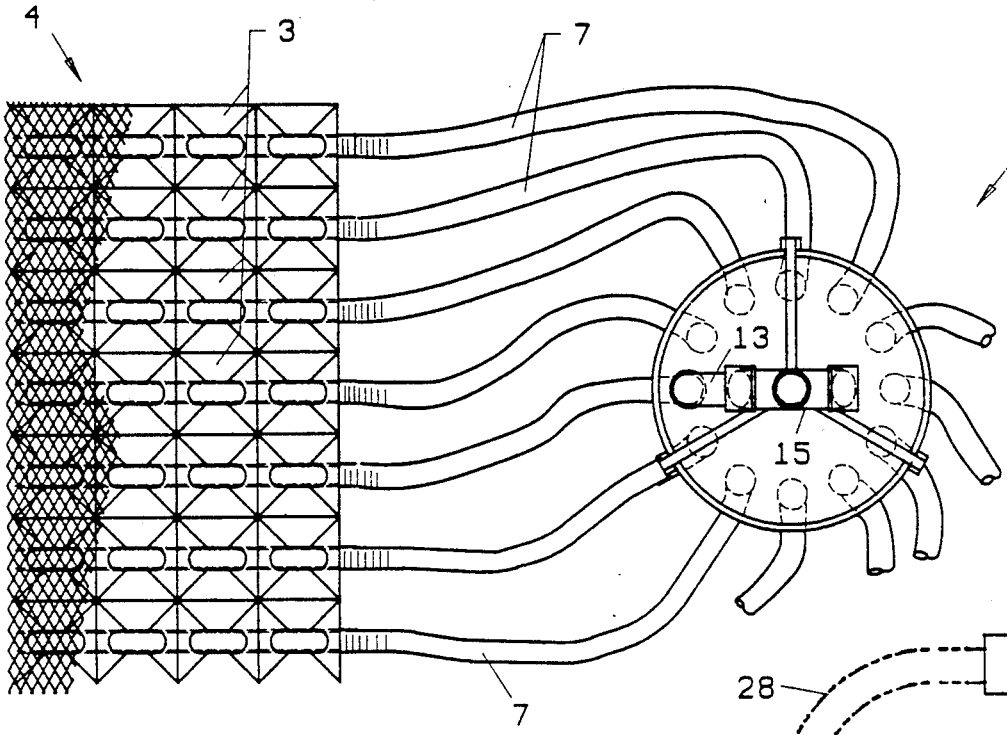
FIG. 1 is a diagrammatic top view of a tube selector mechanism made in accordance with the present invention highlighting its coupling to a tube and hopper arrangement within a full floor media recovery system.

As illustrated in the drawings, the embodiment of the pneumatic tube selector mechanism 1 chosen for the purpose of illustration includes an intake manifold 5 that connects to a plurality of media recovery tubes 7. A selector plate 9 that includes an opening 11 and is rotationally coupled to the intake manifold. A vacuum duct 13 is coupled between the selector plate opening 11 and a vacuum source and is in communication with a venting mechanism 15 that is selectively actuatable to eliminate the vacuum in the region of the selector plate 9. A drive motor 17 is mounted to the intake manifold to rotate the selector plate to selectively couple the selector plate opening 11 with any particular one of the media recovery tubes 7.

The tube selector mechanism 1 may be used in conjunction with a full floor media collection system as previously described or any other system which has a plurality of media recovery sections. As seen in FIG. 1, each of the media recovery tubes 7 may be coupled to a particular tube and hopper section 3 within the media collection system 4. The selector mechanism is designed to selectively couple a vacuum source to individual media recovery tubes. Although it would be possible to apply a vacuum to more than one tube simultaneously, the preferred embodiment individually selects the recovery tubes 7 to maximize the strength of the vacuum applied to each tube.

Figure 2:
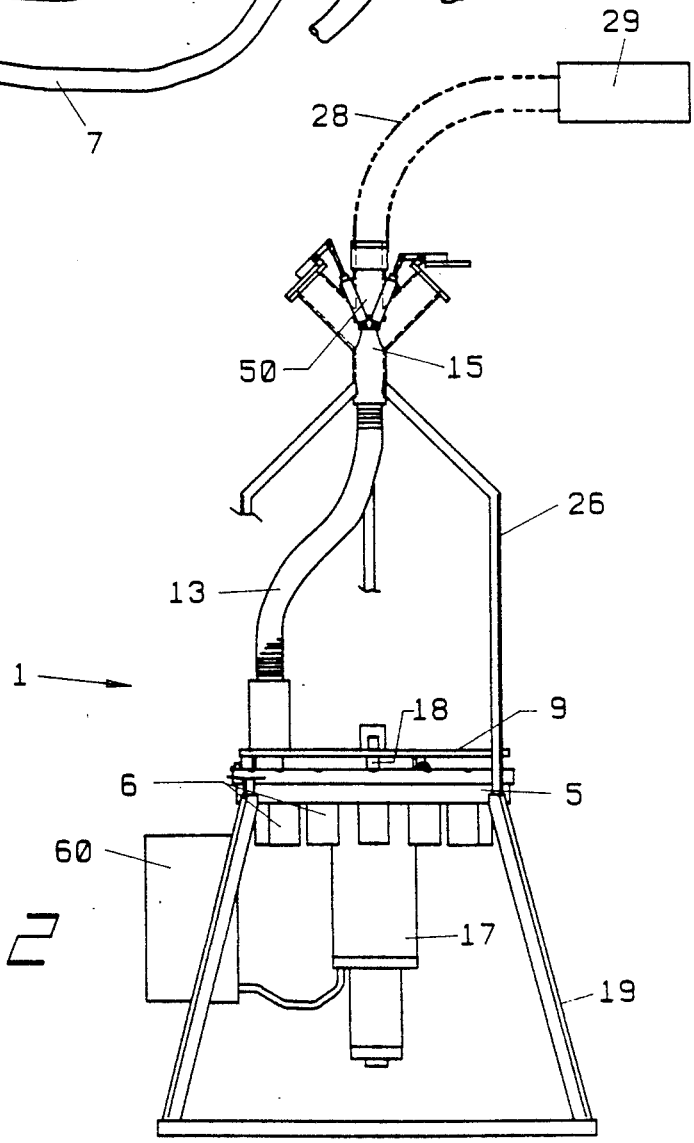
FIG. 2 is a partially broken away diagrammatic side view of the tube selector shown in FIG. 1.

Referring next to FIG. 2, the intake manifold 5 is supported by a base 19. The intake manifold has a multiplicity of tubular intake ducts 6 that extend downward form the intake manifold. A drive motor 17 is mounted to the fixed intake manifold and has drive shaft 18 that extend upwardly through a central opening 21 in the intake manifold and is firmly secured to the center of the rotary selector plate 9. Thus, activation of the drive motor causes the drive shaft and the selector plate to rotate relative to the intake manifold. A frame 26 extends upward from the base 19 in the vicinity of the intake manifold 5 to support the venting mechanism 15. As will be described in more detail below, the venting mechanism includes a four arm adapter 50. A first arm of the four arm adapter 50 extends downward and couples with the vacuum duct 13. A second arm of the four arm adapter extend upward and couples with a second vacuum duct 28 that couples with a vacuum source 29.

Figure 3:
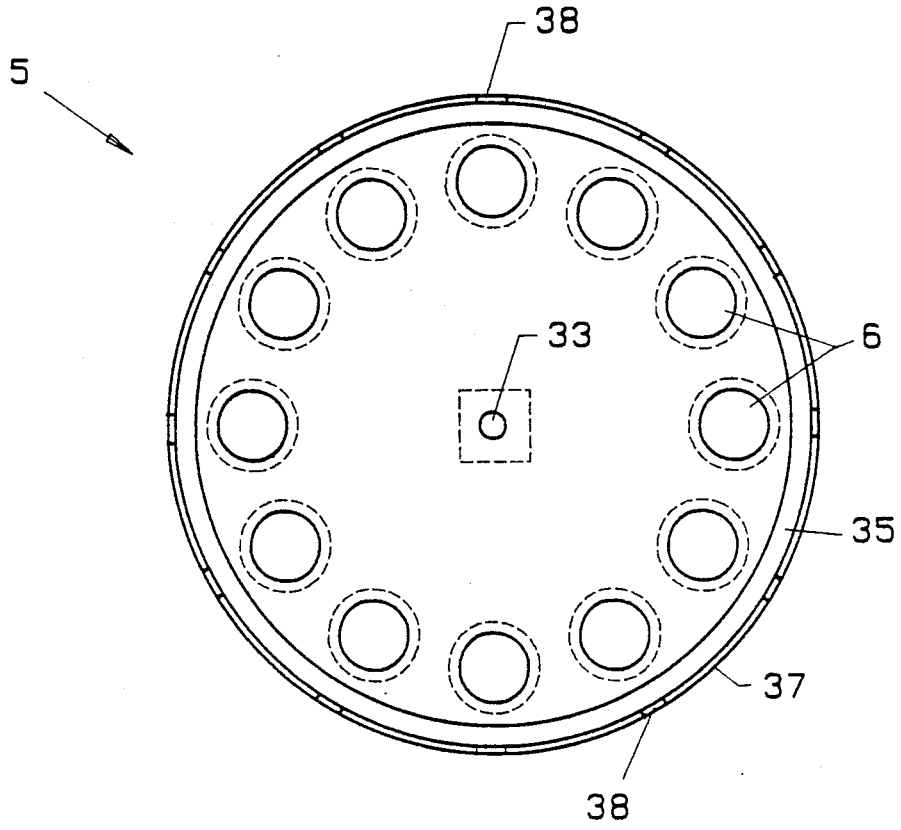
FIG. 3 is diagrammatic top view of the intake manifold for the tube selector shown in FIG. 1.
Figure 4:
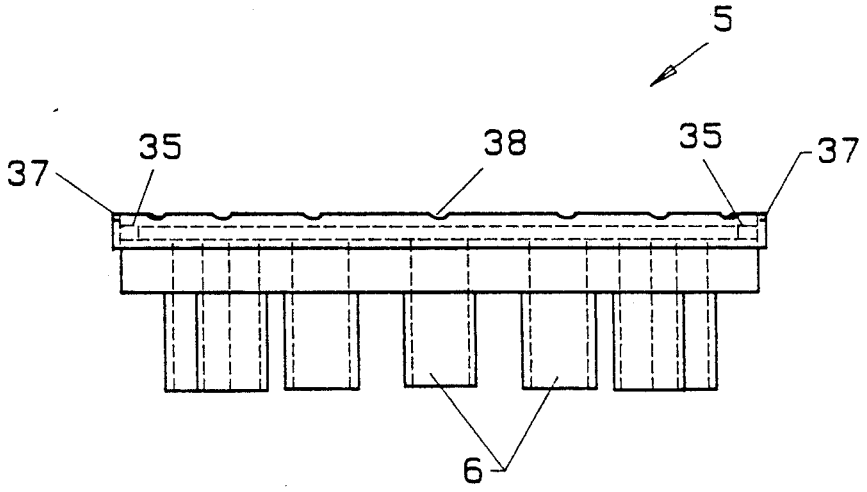
FIG. 4 is a diagrammatic side view of the intake manifold shown in FIG. 3.

Referring next to FIGS. 3 and 4, the intake manifold has a substantially circular platform 31 and has a multiplicity of tubular intake ducts 6 that extend downward from the platform. A central aperture 33 is provided to receive the drive shaft. A raised track 35 extends around the outer side of the intake manifold and a rim 37 extend around the outer perimeter of both the track 35 and the platform 31. The rim 37 has a multiplicity of alignment recesses 38, with each alignment recess corresponding to a particular intake duct. The tubular intake ducts are sized to form male plugs that couple with their associated media recovery tubes.

Figure 5:
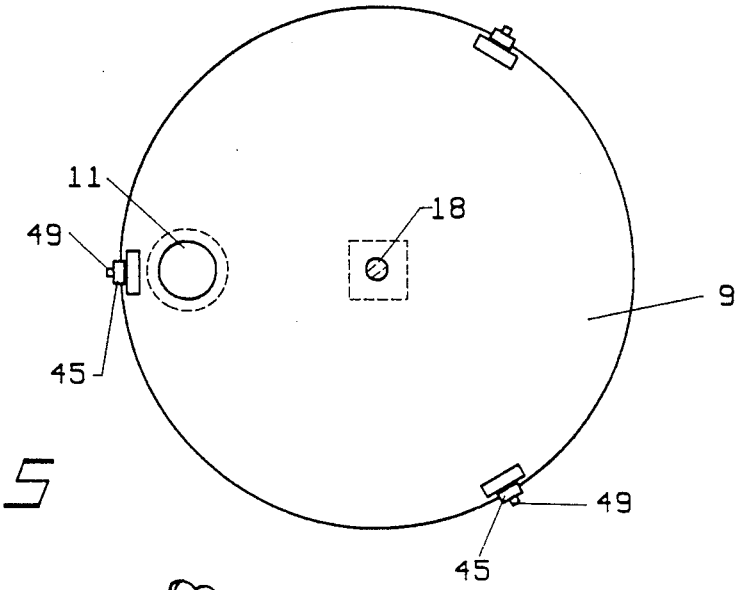
FIG. 5 is a diagrammatic bottom view of the selector plate for the tube selector shown in FIG. 1.
Figure 6:
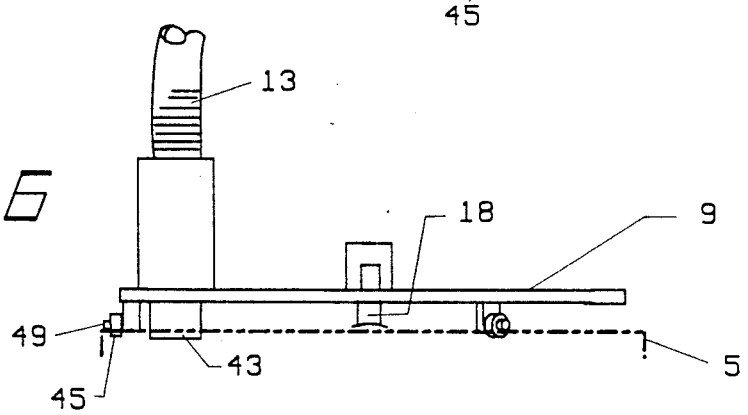
FIG. 6 is a diagrammatic side view of the selector plate shown in FIG. 5.

As best seen in FIGS. 5 and 6, the rotary selector plate 9 is substantially circular and includes a tubular top sleeve 41 that extends upward from the selector plate opening 11 and is coupled to the vacuum duct 13. A tubular bottom sleeve 43 extends downward from the selector plate opening. The bottom sleeve 43 extends downward to just above the intake manifold platform 31 in order to reduce leakage between the selector plate and the intake manifold and to provide a substantially continuous flowpath therebetween.

The selector plate is supported primarily by the motor drive shaft 18 and a plurality of guide rollers 45 that are positioned adjacent the perimeter of the selector plate next to the opening. Each guide roller is arranged such that when the selector plate is installed above the intake manifold, the roller will ride on the track 35 just inside of rim 37. Thus, the roller travels about the track as the selector plate is rotated. Each roller has a cam follower 49 that rides along the rim 37 of the intake manifold. The alignment recesses 38 in rim 37 are arranged such that when the cam rollers are centered within particular alignment recess, the bottom sleeve 43 is precisely positioned over the intake duct that corresponds to the selected alignment recess. Thus, the alignment recesses serve to precisely position the selector plate with respect to the intake ducts. Although in the embodiment chosen for the purpose of illustration three rollers are shown, it should be appreciated that a single roller or other numbers of rollers could be provided as well.

Figure 7:
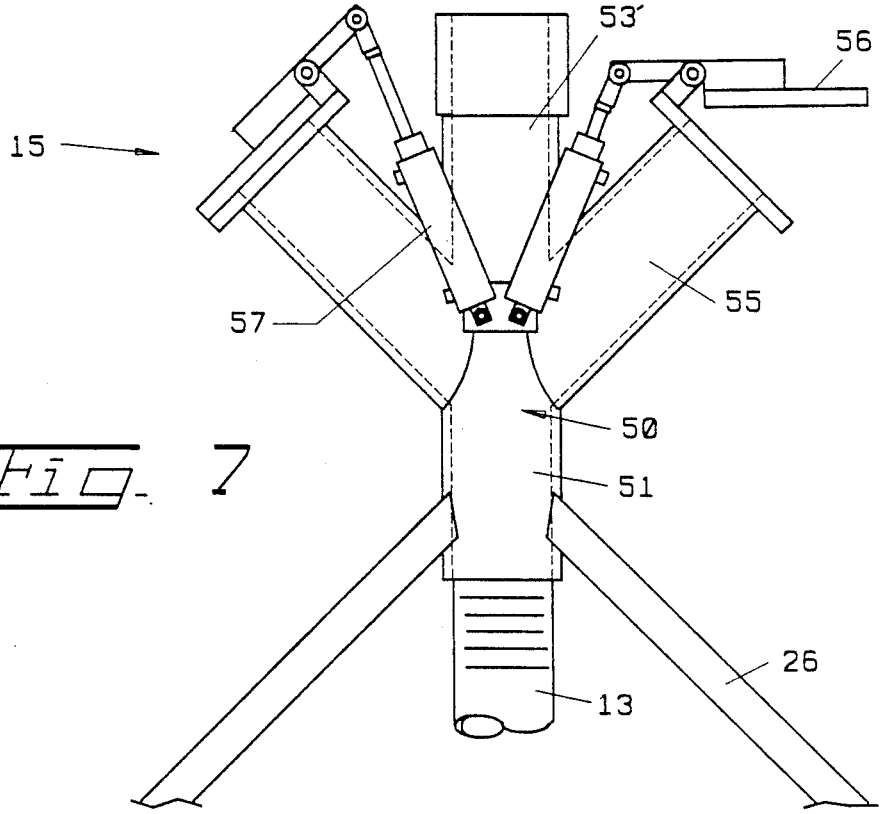
FIG. 7 is a diagrammatic side view of the venting arrangement for the tube selector shown in FIG. 2.

Referring next to FIG. 7, the venting mechanism 15 is provided to remove the vacuum from the region of the selector plate while the selector plate is being removed. Without venting, the abrasive sandblast media will be scattered when the selector plate is rotated. The ending mechanism 15 includes a four arm adapter 50 having a lower arm 51 that connects to the vacuum duct 13 and an upper arm 53 that connects to a duct running between the vacuum source 29 and the rotary tube selector. A pair of vent arms 55 each have a flap 56 that may be selectively opened by actuation of an associated pneumatic piston 57. Actuation of the hydraulic pistons is controlled by the controller 60. The vent arms extend upward to insure that any blasting media that works its way into the vent arms will be immediately returned to the suction flowstream. It is noted that FIG. 7 shows one flap 56 in the open position and the other flap 56 in the closed position for illustrative purposes only, it should be appreciated that the flaps would typically be operated in tandem.

In operation, an electronic controller 60 directs operations of the drive motor to rotate the selector plate relative to the intake manifold. The electronic controller is mounted to the base 19 for convenient access and has wiring extending to both drive motor 17 and the hydraulic pistons 57. The selector plate is initially placed over one of the intake ducts and the vacuum source is started. With this arrangement, the vacuum source is started and the rotary selector mechanism applies suction to the media recovery tube associated with the selected intake duct. The selector plate remains in the first position for a sufficient period of time to suck the spent media collected within the selected tube and hopper section through the tube selector and into the vacuum source. After the vacuum has been run for the appropriate time period, the electronic controller 60 directs the drive motor to increment the selector plate so that the vacuum duct 13 is placed over the next intake duct, wherein the same vacuuming process is repeated. It should be apparent that during continuous operation, the selector plate may be continually stepped in the same fashion about the endless loop that is formed by the multiplicity of intake ducts.

The cam follower on the roller cooperates with the alignment recess adjacent the active vacuum duct to precisely position the selector plate opening over the active vacuum duct. Specifically, the motor is stopped before the selector plate is actually precisely positioned over the selected vacuum duct, but its momentum is sufficient to carry the cam follower into the appropriate alignment recess and the selector plate is effectively positioned by the forces of gravity. The electronic controller also directs the operation of vent flaps 56. In the preferred method of operation, the vacuum source is not started and stopped each time the selector plate is incremented. Rather, during stepping, the vent flaps are opened to vent the vacuum duct. Thus, the electronic controller directs the pistons 57 to contract, thereby raising the vent flaps 56 just before the drive motor is actuated. After the rotary selector plate has been incremented, the pistons are withdrawn, thereby closing the flaps and reapplying suction to the intake manifold.

A shield (not shown) may be placed about the frame, particularly in the region of the gap between the intake manifold and the selector plate to prevent debris in the form of blasting media from being thrown from the selector mechanism.

Although only one embodiment of the present invention has been described in detail herein, it should be understood that the present invention may be embodied in many other specific forms without departing from the spirit or scope of the invention. Particularly, it should be appreciated that the actual control and positioning mechanisms may be widely varied. Similarly, the structure of the venting mechanism and the coupling between the intake manifold and the selector plate may all be widely varied within the scope of the invention. Therefore, the present examples and embodiments are to be considered as illustrative and not restrictive, and the invention is not to be limited to the details given herein, but may be modified within the scope of the appended claims.

I claim:

1. A pneumatic tube selector mechanism for use in conjunction with vacuum generating means for collecting abrasive materials from a plurality of discrete sources, the tube selector comprising:

an intake manifold having a multiplicity of intake ducts arranged in a circle about a manifold centerpoint, each said intake duct being in fluid communication with a particular one of said discrete sources;

a vacuum duct having a first end coupled to the vacuum generating means;

a selector plate rotationally coupled to the intake manifold for rotation about a selector plate axis that extends through said manifold centerpoint, the selector plate having an opening therein that is coupled to a second end of the vacuum duct;

drive means for rotating the selector plate about the selector plate axis to selectively couple the selector plate opening to any particular one of the circularly arranged manifold intake ducts;

positioning means for precisely positioning the selector plate relative to a selected intake duct to insure good fluid communication between said vacuum duct and the selected intake duct; and a roller for rotationally supporting the selector plate upon the intake manifold.

2. A tube selector mechanism as recited in claim 1 wherein the intake manifold includes an annular track about which the roller travels.

3. A tube selector mechanism as recited in claim 2 wherein said positioning means includes a rim adjacent the annular track, the rim having a multiplicity of alignment recesses, and wherein the roller includes a cam follower that follows the rim as the selector plate is rotated, wherein the cam follower cooperates with the alignment recesses to precisely position the selector plate such that the vacuum duct is properly positioned over the selected intake duct.

4. A pneumatic tube selector mechanism for use in conjunction with vacuum generating means for collecting abrasive materials from a plurality of discrete sources, the tube selector comprising:

an intake manifold having a multiplicity of intake ducts arranged in a circle about a manifold centerpoint, each said intake duct being in fluid communication with a particular one of said discrete sources;

a vacuum duct having a first end coupled to the vacuum generating means; plate having an opening therein that is coupled to a second end of the vacuum duct;

drive means for rotating the selector plate about the selector plate axis to selectively couple the selector plate opening to any particular one of the circularly arranged manifold intake ducts;

positioning means for precisely positioning the selector plate relative to a selected intake duct to insure good fluid communication between said vacuum duct and the selected intake duct; and a sleeve in fluid communication with the selector plate opening and extending below the selector plate to partially seal the connection between the vacuum duct and the selected intake duct.

5. A pneumatic tube selector mechanism for use in conjunction with a vacuum generating means to recover abrasive blasting media from a plurality of discrete locations that collect spent media, the tube selector comprising:

an intake manifold having a multiplicity of intake ducts, each said intake duct having an associated intake tube coupled to a particular collection location;

a vacuum duct having a first end coupled to said vacuum generator means;

a selector plate rotationally coupled to the intake manifold, the selector plate having an opening coupled to a second end of said vacuum duct;

drive means for rotating the selector plate relative to the intake manifold to selectively couple the selector plate opening to any particular one of the intake ducts;

vent means for venting the vacuum duct while the selector plate is rotated; and positioning means for precisely positioning the selector plate relative to a selected intake duct to insure good fluid communication between said vacuum duct and the selected intake duct.

6. A tube selector mechanism as recited in claim 5 further comprising an annular track having a plurality of alignment recesses interspersed thereabout that form a portion of said positioning means; and a roller for rotationally supporting the selector plate upon the intake manifold, the roller including a cam follower that follows the track as the selector plate is rotated, wherein the cam followers cooperates with the alignment recesses to precisely position the selector plate such that the vacuum duct is properly positioned over the selected intake duct when the cam follower is centered within the alignment recess associated with the selected intake duct.

7. A tube selector mechanism as recited in claim 5 further comprising a tube that couples the vacuum duct to the vacuum means and wherein the vent means includes a four arm adapter that couples the tube to the vacuum duct, the four arm adapter having a first arm coupled to the vacuum duct, a second arm coupled to a tube, and a pair of vent arms each having selectively actuatable flaps for allowing a substantial influx of air into the tube when opened.

8. A tube selector mechanism as recited in claim 7 wherein said vent arms extend upwardly from their coupling with the vacuum duct to prevent the collection of media therein.

9. A tube selector mechanism as recited in claim 8 further comprising a base stand for supporting the intake manifold and the selector plate.

10. A tube selector mechanism as recited in claim 9 further comprising a frame coupled to the base stand for supporting the vent valve.

11. A tube selector mechanism as recited in claim 10 further comprising a cover shield mounted to said frame for enclosing the region between said intake manifold and said selector plate to contain media within the selector mechanism that escapes between the intake manifold and the selector plate.

12. In an abrasive blasting media recovery system including a plurality of tube and hopper sections for collecting spent blasting media and a vacuum means for recovering the spent sandblast media from the tube and hopper sections, a pneumatic tube selector mechanism for selectively coupling said vacuum means to particular tube and hopper sections, the tube selector mechanism comprising:

an intake manifold having an annular track on its upper surface and a multiplicity of intake ducts, each said intake duct being coupled to a particular tube and hopper section;

a vacuum duct having a first end coupled to the vacuum means;

a selector plate rotationally coupled to the inlet manifold, the selector plate having an opening coupled to a second end of the vacuum duct;

drive means for rotating the selector plate relative to the intake manifold;

vent means for venting the vacuum duct when the selector plate is rotated; and positioning means for precisely positioning the vacuum duct above a selected intake duct to insure good fluid communication between said vacuum duct and the selected intake duct, the positioning means including a roller carried by the selector plate for guiding and rotationally supporting the selector plate on the intake manifold.

13. A tube selector mechanism as recited in claim 12 wherein the roller includes a cam follower and wherein the intake manifold includes an annular track having a rim over which the cam follower travels, and said positioning means further includes a multiplicity of alignment recesses in position the selector plate opening relative to the selected inlet manifold intake duct.

14. A tube selector mechanism as recited in claim 12 wherein said vent means includes a four arm adapter having a first arm coupled to said vacuum duct, a second arm coupled to a duct that couples the vacuum means to the tube selector mechanism, and a pair of upwardly extending vent arms each having selectively actuatable flaps for allowing a substantial influx of air into the tube when opened.

15. A tube selector mechanism as recited in claim 12 further comprising a sleeve extending below said selector plate and being in fluid communication with said selector plate opening to partially seal the connection between the vacuum duct and the selected inlet duct.

16. A tube selector mechanism as recited in claim 14 further comprising:

a base stand for supporting said intake manifold and said selector plate;

a frame coupled to said base stand for supporting said vent valve; and a cover shield mounted to said frame for enclosing the region between said intake manifold and said selector plate to contain media within the selector mechanism that escapes between the intake manifold and the selector plate.

* * * * *